United States Patent [19]

Armstrong et al.

[11] 4,083,336

[45] Apr. 11, 1978

[54] CONDITION RESPONSIVE CONTROL DEVICE

[75] Inventors: James J. Armstrong, East Providence, R.I.; Peter G. Berg, Norton, Mass.

[73] Assignee: Texas Instruments Incorporated, Dallas, Tex.

[21] Appl. No.: 170,542

[22] Filed: Aug. 10, 1971

[51] Int. Cl.[2] ..... F02M 1/12; F02M 1/10

[52] U.S. Cl. ..... 123/119 F; 219/505; 261/39 E; 337/362

[58] Field of Search ..... 123/119 F; 337/362, 337/365; 219/505; 261/39 E

[56] References Cited

U.S. PATENT DOCUMENTS

| | | | |
|---|---|---|---|
| 2,511,318 | 6/1950 | Beard | 123/119 F |
| 3,161,787 | 12/1964 | Van Saan | 123/119 F X |
| 3,179,098 | 4/1965 | Highley et al. | 123/119 F |
| 3,212,486 | 10/1965 | Lorge | 123/119 F |
| 3,213,250 | 10/1965 | Marcoux | 337/365 |
| 3,246,886 | 4/1966 | Goodyear et al. | 123/119 F |
| 3,291,461 | 12/1966 | Pope | 123/119 F |
| 3,317,693 | 5/1967 | Bolesky | 200/138 |
| 3,423,569 | 1/1969 | Cappell et al. | 123/119 F |
| 3,564,199 | 2/1971 | Blaha | 219/505 X |
| 3,632,971 | 1/1972 | Flanagan | 219/505 X |
| 3,651,308 | 3/1972 | Kurokawa et al. | 219/505 |
| 3,699,937 | 10/1972 | DePetris | 123/119 F |

*Primary Examiner*—Wendell E. Burns
*Attorney, Agent, or Firm*—John A. Haug; James P. McAndrews

[57] ABSTRACT

A condition responsive control device is disclosed for affecting operation of a choke control in response to variable ambient and system temperatures, as well as the use of such a device in a system in which it is desired to adjust an operating parameter of the system in response to such temperatures. The device includes an ambient temperature sensing switch which remains de-energized in response to ambient temperatures below a first preselected temperature level and is energized in response to temperatures in excess of this level so as to transmit an electrical signal in response to energization. The device also includes a system temperature sensing thermostatic coil which remains unactuated in response to system temperatures below a second preselected temperature level and is actuated in response to temperatures above this level so as to effect an operating parameter of the system. A self-regulating heating element is thermally coupled to the system temperature sensing coil and is adapted to generate heat at a substantially constant temperature level in response to electrical energization thereof. The heating element is electrically coupled to the ambient temperature sensing switch and is energized in response to the electrical signal to effect accelerated heating of the system temperature sensing coil to said second preselected temperature level.

2 Claims, 4 Drawing Figures

CONDITION RESPONSIVE CONTROL DEVICE

The present invention relates generally to a condition responsive control device and more particularly is directed to a device for sensing ambient temperature as well as system temperature for affecting operation of a choke in response thereto.

Numerous systems are presently utilized in which it is desirable to control or adjust an operating parameter of the system in response to an internal condition of the system such as temperature, speed, etc. while similarly sensing an external parameter such as ambient temperature so as to achieve a desired mode of operation of the system. Particularly in the automotive field a great need has arisen in recent years in attempting to reduce exhaust pollutants to regulate the ratio of fuel to air in the fuel-air mixture being supplied by the carburetor so as to achieve the largest ratio of air to fuel which is possible, while permitting smooth running of the engine without damage or stalling. Such a need has become particularly important since conventional choke assemblies provided for use with conventional internal combustion engines for initially maintaining a higher ratio of fuel to air while the engine is in a cold condition and in particular when ambient temperatures are relatively low while increasing the ratio of air to fuel in the mixture as the engine approaches its normal operating temperature have suffered from certain deficiencies, and have not functioned to sufficiently reduce the level of undesired impurities in the exhaust gas. Although various systems have been proposed for controlling the choke operation for accomplishing improved operation in reducing exhaust pollutants certain problems continue to arise. For example, in situations in which the ambient temperature is at a level above approximately 60° F. it is desirable to deliver a fuel to air mixture to the engine which has a somewhat higher ratio of fuel to air than the engine requires when it has reached its normal operating temperature for only a very small time interval in comparison with situations involving a lower ambient temperature. However, due to the relative inability of the choke assembly to compensate for the increased ambient temperature as compared with a relatively cold ambient temperature of perhaps 0° F., conventional automative choke assemblies are somewhat incapable of accomplishing this function in as short a period of time as may be desirable due to the inherent time delay of the chocking system so that the fuel to air mixture contains a higher ratio of fuel to air for a longer period of time than is necessary and increased emission of undesired materials in the exhaust gas results. In order to alleviate this problem certain proposals have been made for heating the temperature responsive mechanism of the choke assembly but have been generally unsuccessful due to the introduction of additional complex mechanisms and systems. For example, it has been proposed to utilize a resistance heater. However, the introduction of such an element requires additional switching mechanisms for energizing and de-energizing the resistance heater. In addition, a resistance heater is often sensitive to variations in voltage, current, etc., as well as being affected by the adverse environmental situation in the engine compartment and improper system operation often results.

Accordingly, it is an object of the present invention to provide an improved condition responsive control device for affecting operation of a temperature dependent system.

It is another object of the present invention to provide an improved temperature responsive control device which senses ambient and system temperature and is adapted to adjust an operating parameter of the system in response to these sensed temperatures.

It is a further object of the present invention to provide an improved temperature responsive control device adapted to control the fuel-air mixture valve of a carburetor of a conventional internal combustion engine in response to ambient and engine temperature so as to effect accelerted opening of the valve when ambient temperature is above a preselected temperature level.

Various additional objects and advantages of the present invention will become readily apparent to those skilled in the art from the following detailed description and accompanying drawings wherein.

Figure 1:
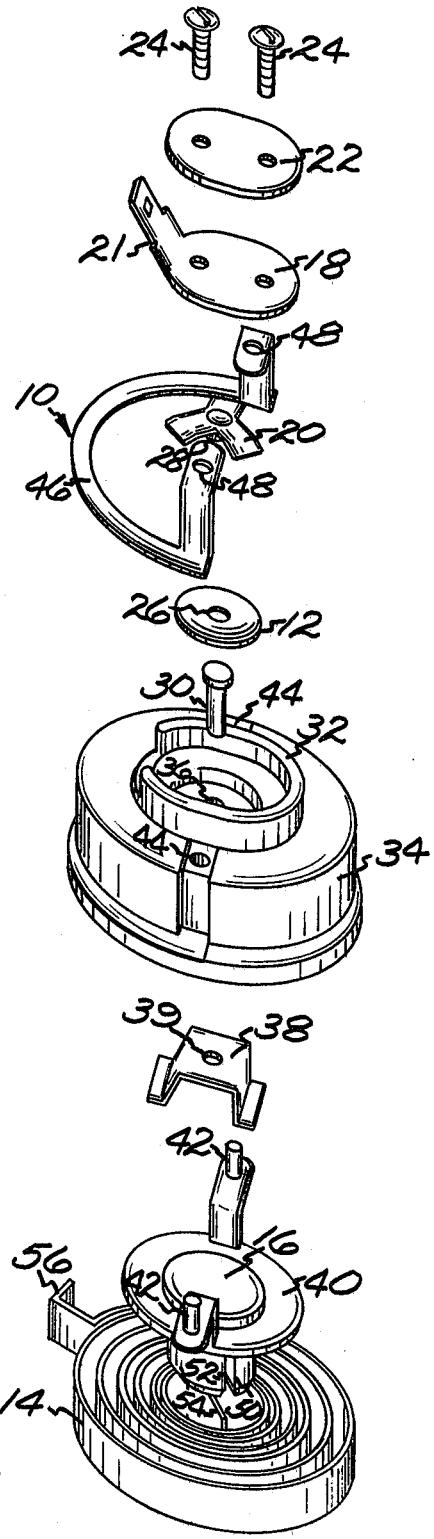
FIG. 1 is a perspective exploded view of a control device in accordance with the present invention.
Figure 2:
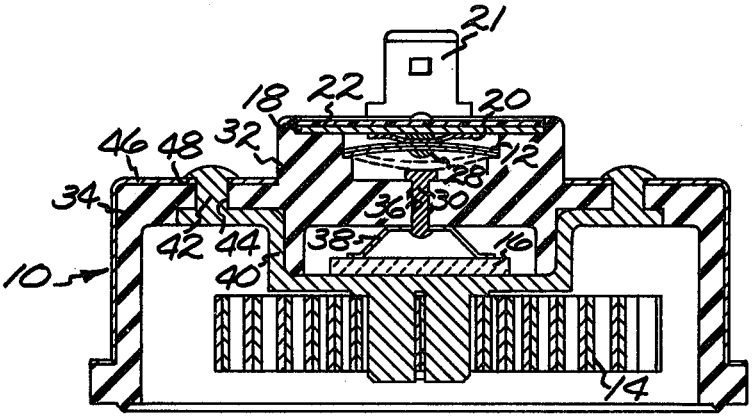
FIG. 2 is a vertical sectional view of the device of FIG. 1.

Referring generally to the drawings and initially to FIGS. 1 and 2 a control device in accordance with the present invention is designed generally by the reference numeral 10. Very generally, the device 10 includes an ambient temperature switch means 12 which remains in an unactuated or de-energized state in response to ambient temperatures below a first preselected temperature level and which is energized or actuated in response to a temperature level in excess of this level. The ambient temperature switch means is adapted to be coupled to a source of electrical power (not shown) for transmitting an energizing electrical signal when it is in an actuated condition. In addition, a system temperature thermally responsive thermostatic coil spring means 14 is provided adapted to be maintained in thermal communication with the system being controlled or adjusted. The system temperature sensing coil spring means 14 which controls the choke valve position will cause the fuel-air mixture valve to remain closed in response to sensed system temperatures below a second preselected temperature level and will cause the valve to open in response to temperatures above this second preselected temperature level so as to affect the fuel air ratio. The device further includes a selectively energizable self-regulating heating element 16 thermally coupled to the system temperature sensing coil spring means 14 and adapted to generate heat at a substantially constant temperature in response to electrical energization thereof. The heating element 16 has a steeply sloped positive temperature coefficient of resistance at temperatures above an anomaly temperature in excess of the second preselected temperature level. The heating element is coupled to the ambient temperature switch means 12 only when the ambient temperature switch means is in its actuated condition such that actuation of the ambient temperature switch 12 effects the energization of the heating element thereby effecting accelerated heating of the system temperature coil spring means 14 in response to elevated ambient temperatures.

More particularly, the ambient temperature sensing switch means 12 preferably comprises a thermostat member, having a plurality of metal lamine (as particularly shown in FIG. 2), which is adapted to be maintained in continuous electrical contact with the source of electrical power and which remains in its unactuated state when the ambient temperature is below a first preselected temperature level but which is actuated in response to ambient temperatures above this temperature level to effect the establishment of a bridging electrical contact between the source of electrical power and the heating element 16. As a result electrical signals are transmitted to the heating element 16 to effect electrical energization thereof, thereby causing the application of additional heating to the temperature sensing coil spring means 14. The thermostat member 12 preferably comprises a generally disc-shaped thermostat member, which in the illustrated embodiment has an upper surface of a generally convex shape. This upper surface is maintained in electrical communication with a conductive plate 18 disposed in spaced relationship with the upper surface of the thermostat member 12 and maintained in electrical communication therewith by a spring-like contact member 20 disposed in contact with and intermediate the convex surface of thermostat member 12 and the conductive plate 18. The conductive plate further includes a projecting lug or terminal 21 adapted to be connected to a source of electrical power and, if desired, an insulating protective plate 22 may be secured above the conductive plate 18 by a plurality of screws 24 or the like. The thermostat member 12 includes a generally centrally located aperture 26 which is adapted to accommodate a depending member 28 of the spring contact 20.

A conductive contact member 30 which may comprise a conductive headed rivet, or the like, is disposed adjacent the opposite concave surface of the thermostat member 12 in axial registry with the aperture 26 and with depending member 28 of the spring contact but in selective disengagement therewith, while the disc thermostat 12 remains in its unactuated condition. As shown, particularly in FIG. 2 the depending member 28 extends through the aperture 26 and remains spaced from the contact member 30, while the thermostat member 12 remains in its unactuated condition but is adapted to engage the contact member 30, when the thermostat member 12 deflects into its overcenter position (shown in phantom) in response to a second ambient temperature level in excess of the first preselected temperature level, thereby establishing electrical communication between the contact member 30 and the conductive plate 18.

The thermostat member 12, as well as the conductive plate 18 and the spring contact 20 are all supported within an upwardly projecting housing 32 on a surface of a support casing 34. The casing 34 also includes a generally centrally located aperture 36 within the portion thereof surrounded by the housing 32, which accommodates the conductive contact member 30. The contact member 30 extends through this aperture 36 with one end thereof being secured against the surface of the casing as shown in selective disengagement with the depending member 28 of the spring contact 20 and its opposite end extending through the inner surface of the casing where it contacts and is secured against another conductive contact member 38 which is also preferably fabricated of a spring-like material. The contact member 38 includes an aperture 39 for receiving the member 30, which is preferably crimped thereagainst to maintain the member 38 in position. The opposite end of contact member 38 bears against a contact surface of the heating element 16 so that electrical contact is maintained between heating element 16 and the contact member 30. Thus, upon deflection or actuation of thermostat member 12 into engagement with the contact member 30 bridging electrical contact is established between the conductive plate 18 and the contact surface of the heating element 16.

The heating element 16 preferably comprises a self-regulating positive temperature coefficient of resistance thermistor having a steeply sloped positive temperature coefficient of resistance at temperatures above an anoamly or transition temperature, whereby application of electrical energization thereto causes the heating element to self-heat and reach a predetermined temperature level which remains substantially constant responsive to continuous electrical energization thereof as a result of the substantial increase in resistance of the heating element at this temperature level. Such an element is quite advantageous since it heats up to this temperature level relatively rapidly and then retains that temperature in response to continued energization. A particularly advantageous heating element comprises a ceramic wafer comprising semiconducting barium titanate, such as $BA_{.997}La_{.003}Tio_3$. As shown the heating element 16 is preferably mounted on a thermally conductive heat-sink member 40 which is in electrical contact with a contact surface thereof opposite to the contact surface which contacts the spring contact member 38. The heat sink member 40 is preferably fabricated of a material having a relatively high thermal conductivity and a substantial thermal inertia, such as zinc, and, as shown, includes a pair of mounting studs 42 which are adapted to be received within accommodating apertures 44 in the casing 34 so as to facilitate mounting of the heating element 16 and the heat-sink 40 within the casing. In addition, in order to facilitate connection of the device a semi-circular conductive ground strap member 46 is secured to the upper surface of the casing 34 and supported on the rim thereof. This member includes a plurality of apertures 48 in registry with the apertures 44 on the casing for receiving the studs 42 therethrough so as to facilitate maintenance of the heat sink member and a contact surface of the heating element 16 at ground potential, while the other contact surface is connectable to the source of electrical power. In addition, a rigid member 50 depends from the opposite surface of the heat sink member 40 and includes a slot 52 therein for mounting the system temperature sensing coil spring means 14 in thermal communcation with the heating element 16. Thus, the heat generated by the heating element 16 is efficiently transferred to the system temperature sensing coil spring means 14 and the substantial thermal inertia of the heat-sink member 40 causes the system temperature switch 14 to retain its elevated temperature level for a substantial period of time subsequent to removal of heating so as to maintain the system temperature coil spring means 14 at an elevated temperature and hence in an actuated condition subsequent to a decrease in system temperature which is advantageous in instances in which the system is shut down and cools, but in which it is desired that the system temperature sensing cool spring 14 remain in an actuated condition so as to effect the desired adjustment of an operating parameter of the system in a minimal time interval.

The system temperature sensing coil spring means 14 preferably comprises a thermally actuatable movable member, such as a member formed of thermostat material having a plurality of metal laminae having different coefficients of thermal expansion. In this connection the system temperature sensing switch means 14 preferably comprises a member in the form of a spiral of at least one continuous convolution and is illustrated having a plurality of convolutions with its origin 54 being ridigly mounted within the slot 52 so as to restrain movement thereof, while its terminus 56 is adapted to be mechanically linked to a valve assembly or the like, as will be subsequently explained, and is permitted to move relative to the origin 54 in response to an elevated sensed temperature level. Thus, the device 10 is adapted to be mounted such that the thermostat member 14 is in thermal communication with the system the parameter of which is being adjusted or controlled, and since the reaction of the thermostat member 14 in certain instances may be insufficiently rapid to affect operation in a desired time interval, such as when ambient temperature is above a certain level and operation should be more rapidly affected, the ambient temperature sensing thermostat 12 deflects thereby effecting energization of the heating element 16, which applies additional heating to the thermostat member 14, thereby causing it to operate at a substantially accelerated rate, whereby the relative movement of its terminus 56 occurs at an accelerated rate in order to affect system operation in the desired manner.

Figure 3:
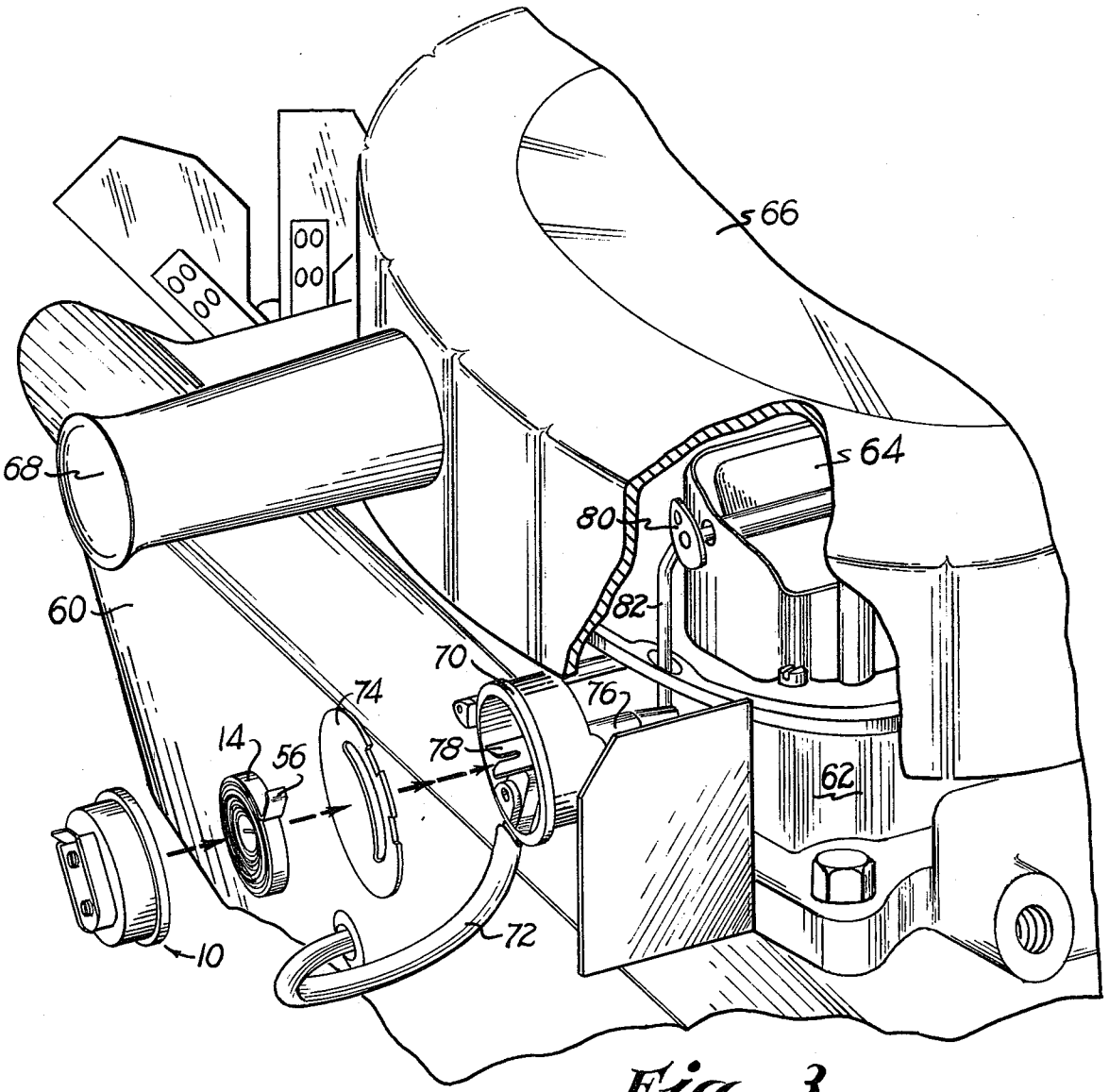
FIG. 3 is a fragmentary partially exploded perspective view partially cut-away of a portion of a conventional internal combustion engine provided with a control device in accordance with the present invention.

Referring now to FIG. 3 one of the particularly advantageous uses of the device 10 in accordance with the present invention is illustrated. More particularly, the device is shown employed in conjunction with a typical conventional internal combustion engine for adjusting the ratio of fuel to air in the fuel-air mixture being delivered by the carburetor for adjusting the fuel-air mixture valve of the carburetor in response to varying ambient and engine temperature conditions. In accordance with the present invention, a solution is provided for the problem of reducing the undesired impurities or pollutants in the exhaust gas of such an engine particularly in situations in which the engine is in its warm-up phase starting from a cold condition. In such situations an unacceptably high level of pollutant emission is known to occur due to the rich fuel to air ratio required. In this connection it is normally desirable to provide a choking action, when starting a cold engine, by virtue of which the ratio of fuel to air is increased in order to prevent stalling and misfire of the engine. However, it is desirable to reduce the ratio of fuel to air by increasing the relative amount of air in the mixture as quickly as possible in order to prevent the emission of undesired impurities in the exhaust gas. Conventional choke assemblies have been somewhat unable to cope with this situation in view of the fact that a substantial time period is required before the sensed engine temperature causes the choke assembly to lean-out the fuel mixture to the desired ratio. This is particularly true in situations in which the ambient temperature air which is being supplied to the engine is of a temperature above approximately 60° F. in which the choking action for providing a richer fuel mixture is only required for a relatively brief time interval. In accordance with the present invention the device 10 is adapted to sense ambient air temperature, as well as engine temperature, so as to rapidly increase the ratio of air to fuel in the fuel-air mixture being delivered by the carburetor and is particularly advantageous in reducing undesired exhaust gas impurities in situations in which the ambient temperature air is above a preselected temperature level, when the engine does not require a rich fuel to air mixture for more than a very brief time interval.

More particularly, a portion of a conventional internal engine assembly indicated generally by the reference numeral 60 is shown including a carburetor 62 mounted thereon, the carburetor having a fuel-air mixture valve 64 conventionally referred to as the butterfly valve. As shown an air cleaner 66 is mounted above the carburetor 62 and includes a fresh air inlet port 68 for supplying air to the carburetor, while the butterfly valve 64 regulates or adjusts the amount of fresh air being supplied to the carburetor so as to adjust the fuel-air mixture being delivered by the carburetor. The device 10 is illustrated mounted on the engine 60 such that the engine temperature sensing thermostat coil spring member 14 is in thermal communication with the engine. In this regard a mounting 70 is provided adjacent the carburetor 62 as shown for accommodating the device 10. An air hose 72 is connected between the mounting and the interior of the engine block 60 for delivering heated air circulating within the engine to the mounting 70 and hence to the engine temperature sensing thermostat coil spring member 14 such that the temperature of internal engine gases may be sensed by the engine temperature sensing thermostat coil spring 14 which is secured to the mounting 70. In addition, a vacuum gasket 74 is preferably provided to facilitate mounting of the device 10. As shown, a rotatably mounted member 76 extends through the mounting 70 and includes a slotted end 78 as shown adapted to receive the terminus 56 of the thermostat coil spring member 14 therein. The rotatably mounted member 76 is connected to a pivotally mounted plate 80 by a linking shaft 82, the plate 80 in turn being connected to the butterfly valve 64 for effecting pivotal movement thereof so as to effect opening and closing of the valve 64, thereby controlling the ratio of air to fuel in the fuel-air mixture being delivered by the carburetor 62. It may be seen that movement of the terminus 56 of the thermostat coil spring member 14 in response to temperature changes effects rotation of the member 76 and hence effects pivotal movement of the pivotally mounted plate 80 and opening and closing of the butterfly valve 64. Thus, during operation when the engine is in a relatively cold state and is initially started the thermostat coil spring member 14 is in its contracted or unactuated state and the rotatably mounted shaft 76 maintains the butterfly valve in a closed position so that a relatively rich fuel-air mixture is delivered. However, as engine temperature increases this increased temperature is sensed by the thermostat coil spring member 14 and the terminus 56 moves relative to the origin effecting rotation of member 76 and hence opening of the butterfly valve 64. In situations in which the ambient temperature air is above a preselected temperature level and it is desirable to effect more rapid actuation of the thermostat coil spring member 14 and associated movement 56 of the terminus thereof to effect opening of the butterfly valve 64 at a more rapid rate, in accordance with the present invention the ambient temperature sensing disc theremostat 12 deflects into its over-center position and effects energization of the self-regulating heating element 16, which effects accelerated heating of the thermostat coil spring member 14 and thereby causes actuation thereof and movement of the terminus 56 to effect opening of the butterfly valve 64 at a more rapid rate. Thus, in situations in which the temperature of the ambient air is such that the engine need not run on a rich fuel to air mixture for a prolonged period of time the present invention causes leaning-out of the fuel-air mixture at an accelerated rate thereby reducing exhaust gas pollutants. Furthermore, the accelerated heating of the thermostat coil spring member 14 which is provided enables the thermostat coil spring member 14 to relatively closely track or analogue the internal engine gas temperature and respond in accordance with the level of this temperature.

Figure 4:
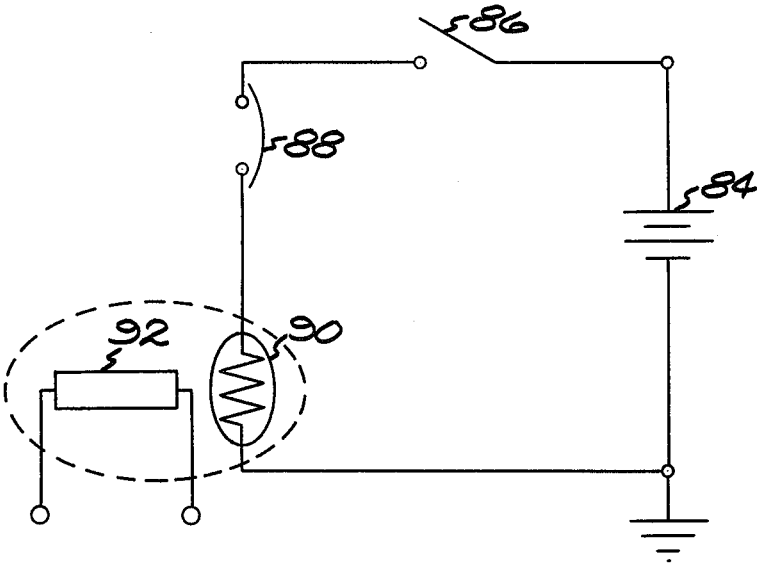
FIG. 4 is a partially diagrammatic electrical schematic circuit diagram illustrative of the function of a control device in accordance with the present invention.

The electrical function of the device 10 is particularly illustrated in a simplified manner in FIG. 4. More particularly, in FIG. 4 a power supply 84 is shown which may be generally representative of the automobile battery or alternator which is connected via a switch 86 which may be generally representative of the automobile ignition switch through the disc thermostat member 12 and to the heating element 16. In addition, thermostatic coil spring member 14 thermally coupled to the heating element 16 and receives heat from the heating element in response to energization thereof. Thus, in operation on closure of a switch 86 the thermostat 12 is energized and if the ambient temperature is above a preselected temperature level is closed thereby supplying electrical power to the heating element 16 which in turn begins to self-heat and effects heating of the thermostat spring coil member 14 so as to effect accelerated operation thereof.

Thus, a unique temperature responsive control device which is responsive to both ambient and system temperature conditions has been disclosed, as well as the use of such a device in a particularly advantageous manner for controlling an operating parameter of a particular system such as a conventional internal combustion engine.

Various changes and modifications in the above-described device will be readily apparent to those skilled in the art and any of such changes or modifications are deemed to be within the spirit and scope of the present invention as set forth in the appended claims.

We claim:

1. A temperature responsive device adapted for use in reducing undesired material in the exhaust gas emitted by an internal combustion engine powered by a combustible fuel-air mixture, said device comprising a casing adapted to be carried on the engine, said casing including an aperture, a fixedly mounted conductive contact member disposed within said aperture, an ambient temperature sensing switch comprising a generally disc-shaped thermostat member of thermostat material having a plurality of metal laminae having unequal coefficients of thermal expansion carried adjacent the aperture at one surface of said casing in a position spaced from said fixedly mounted conductive contact member and adapted to electrically communicate with said contact member upon deflection thereof in response to a preselected ambient temperature at said casing, said thermostat member having a generally centrally located aperture, means for selectively connecting said thermostat member to a source of electrical power including a contact member coupled to the source of electrical power and supported within said aperture in said theremostat member projecting therethrough terminating in spaced facing relationship with said fixedly mounted contact member for selectively contacting said fixedly mounted contact member only upon deflection of said thermostat member, an engine temperature sensing thermally responsive means, means to thermally couple the engine to the thermally responsive means for sensing the temperature of the engine, the thermally responsive means comprising a member formed of thermostat material having a plurality of metal laminae having unequal coefficients of thermal expansion and being formed in a continuous coil having a plurality of convolutions including an origin fixedly connected to the casing and a terminus adapted to move relative to the origin in response to an elevated temperature of the coil at said casing, said terminus being adapted to be coupled to a valve for adjusting the ratio of the fuel-air mixture, and a self-regulating heating element supported by said casing in contact with said fixedly mounted contact member and in thermal communication with said engine temperature sensing coil, said heating element being adapted to generate heat at a substantially constant temperature at said casing in response to electrical energization thereof upon deflection of said thermostat member and having a positive temperature coefficient of resistance and a sharply defined transition temperature above which its resistance increases abruptly whereby deflection of said thermostat member in response to said preselected ambient temperature at said casing effects heating of said engine temperature sensing coil and associated movement of said terminus.

2. A temperature responsive device adapted for use in reducing pollutants in the exhaust gas emitted by an internal combustion engine powered by a combustible fuel-air mixture comprising a casing adapted to be carried on the engine, said casing having a bottom and a side wall defining a generally cup-shaped casing chamber, having an aperture extending through the casing bottom, and having a flange inside the casing chamber upstanding from the casing bottom around said aperture, a fixedly mounted conductive contact member disposed within said aperture, an ambient temperature sensing switch comprising a thermostat member having a plurality of metal laminae having unequal coefficients of thermal expansion carried adjacent said aperture at one surface of said casing bottom in a position normally spaced from one end of said fixedly mounted conductive contact member and adapted to electrically engage said one end of the contact member upon deflection of the thermostat member in response to the occurrence of a preselected ambient temperature at said casing, means electrically connecting said thermostat member to a source of electrical power for selectively connecting said fixedly mounted contact member to said source of electrical power only upon said deflection of said thermostat member in response to said preselected ambient temperature at said casing, a thermally and electrically conductive metal plate secured to the casing against said casing flange over said casing aperture to be electrically connected to electrical ground, an engine temperature sensing thermally responsive means mounted within said casing chamber to be thermally coupled to the engine for sensing the temperature thereof, said thermally responsive means comprising a member formed of thermostat material having a plurality of metal laminae having unequal coefficients of thermal expansion and being formed in a continuous coil having a plurality of convolutions including a coil origin fixedly secured to said plate and a coil terminus adapted to move in response to an elevated temperature of said coil at said casing, said terminus being adapted to be coupled to a valve for adjusting the ratio of the fuel-air mixture powering said engine, and a self-regulating electrical heating element secured to one side of said plate to be surrounded by said casing flange in electrical contact with an opposite end of said fixedly mounted contact member and in thermal communication with said engine temperature sensing coil, said heating element being adapted to generate heat at said casing at a substantially constant temperature in response to electrical energization thereof upon said deflection of said thermostat member and having a positive temperature coefficient of resistance and a sharply defined transition temperature above which its resistance increases abruptly; whereby said deflection of said thermostat member in response to the occurrence of said preselected ambient temperature at said casing effects selected heating of said engine temperature sensing coil and selected movement of said coil terminus.

* * * * *